US009997843B2

(12) United States Patent
Warnick

(10) Patent No.: US 9,997,843 B2
(45) Date of Patent: Jun. 12, 2018

(54) BAND-SELECTIVE APERTURE SHADING FOR SIDELOBE REDUCTION IN TX/RX PHASED ARRAY SATELLITE COMMUNICATIONS TRANSCEIVERS

(71) Applicant: Brigham Young University, Provo, UT (US)

(72) Inventor: Karl F. Warnick, Spanish Fork, UT (US)

(73) Assignee: BRIGHAM YOUNG UNIVERSITY, Provo, UT (US)

( * ) Notice: Subject to any disclaimer, the term of this patent is extended or adjusted under 35 U.S.C. 154(b) by 182 days.

(21) Appl. No.: 15/014,986

(22) Filed: Feb. 3, 2016

(65) Prior Publication Data

US 2016/0226155 A1 Aug. 4, 2016

Related U.S. Application Data

(60) Provisional application No. 62/125,913, filed on Feb. 3, 2015.

(51) Int. Cl.

| | |
|---|---|
| ***H01Q 21/06*** | (2006.01) |
| ***H01Q 21/00*** | (2006.01) |
| ***H01Q 9/04*** | (2006.01) |

(52) U.S. Cl.
CPC ..... *H01Q 21/065* (2013.01); *H01Q 9/0407* (2013.01); *H01Q 21/0075* (2013.01)

(58) Field of Classification Search
None
See application file for complete search history.

(56) References Cited

U.S. PATENT DOCUMENTS

| | | | | |
|---|---|---|---|---|
| 6,252,556 | B1 * | 6/2001 | Ito | H01Q 9/0428 343/700 MS |
| 7,167,129 | B1 * | 1/2007 | Strassner, II | H01Q 9/0407 343/700 MS |
| 2005/0030245 | A1 * | 2/2005 | Croswell | H01Q 9/16 343/795 |

* cited by examiner

*Primary Examiner* — Graham Smith
(74) *Attorney, Agent, or Firm* — Kunzler, PC

(57) ABSTRACT

For phased array aperture shading for sidelobe reduction in satellite communication transceivers, apparatus and systems are disclosed. One apparatus includes a planar array antenna tile having a plurality of patch antenna elements. The apparatus also includes a transmit feed point that drives the planar array antenna tile. The apparatus further includes a feed network element that distributes power unequally among two or more of the patch antenna elements, wherein the feed network element connects the two or more patch antenna elements to the transmit feed point.

18 Claims, 9 Drawing Sheets

BAND-SELECTIVE APERTURE SHADING FOR SIDELOBE REDUCTION IN TX/RX PHASED ARRAY SATELLITE COMMUNICATIONS TRANSCEIVERS

CROSS-REFERENCES TO RELATED APPLICATIONS

This application claims priority to U.S. Provisional Patent Application No. 62/125,913 entitled "BANKD-SELECTIVE PHASED ARRAY SHADING FOR SIDELOBE REDUCTION IN TX/RX SATELLITE COMMUNICATIONS TRANSCEIVERS" filed on Feb. 3, 2015 for Karl F. Warnick, which is incorporated herein by reference.

FIELD

This invention relates to wireless communications and more particularly relates to antennas for satellite communications.

BACKGROUND

Satellite communication terminals typically rely on reflector antennas, which are high gain at relatively low cost. For mobile applications, reflector antennas must be mechanically steered to point the antenna at a desired satellite. However, the mechanical systems for aiming the antenna are bulky and expensive. To improve the performance of mobile satellite terminals and eliminate the need for mechanical steering, mechanically steered antennas can be replaced by a phased array antenna with electronic beam steering.

Mobile satellite terminals often shape the beam of the transmit signal to satisfy regulatory sidelobe pattern mask requirements and avoid interference with the uplink signal impinging on other satellites adjacent to the intended target satellite. This is accomplished by shading or tapering the amplitude of the illumination pattern over the area of the antenna aperture.

BRIEF SUMMARY

Apparatuses for band-selective aperture shading for sidelobe reduction in Tx/Rx phased array satellite communications transceivers are disclosed. A system for band selective phased array aperture shading for sidelobe reduction in satellite communications transceivers is also disclosed which may include the apparatuses.

One apparatus includes a planar array antenna tile having a plurality of patch antenna elements. The apparatus also includes a transmit feed point that drives the planar array antenna tile. The apparatus further includes a feed network element that distributes power unequally among two or more of the patch antenna elements, wherein the feed network element connects the two or more patch antenna elements to the transmit feed point.

In some embodiments, the feed network element includes an unequal power splitter. In certain embodiments, the unequal power splitter includes a printed circuit board ("PCB") trace, the PCB trace having a first branch connecting a first patch antenna element to the transmit feed point and a second branch connecting a second patch antenna element to the transmit feed point, where the width of the first branch is greater than the width of the second branch.

In one embodiment, the plurality of patch antenna elements includes a plurality of interior elements and a plurality of edge elements. In such an embodiment, the feed network element distributes transmit power at a first level to one or more interior elements and at a second power level to one or more edge elements, the first power level being greater than the second power level. In a further embodiment, the apparatus may include a second feed element that distributes transmit power to an edge element at the first power level. In certain embodiments, the plurality of patch until elements further include one or more corner elements, wherein the feed network element distributes transmit power at a third power level to at least one of the one or more corner elements. In another embodiment, the plurality of patch antenna elements further includes one or more corner elements, wherein at least one of the corner elements is unconnected to the transmit feed point.

In some embodiments, the apparatus includes a receive feed distribution network and a receive feed point, the receive feed distribution network connecting the plurality of patch antenna elements to the receive feed point. In one embodiment, the receive feed distribution network equally illuminates all patch antenna elements of the tile.

In certain embodiments, the planar array antenna tile is a component of a planar array antenna, the planar array antenna including a plurality of planar array antenna tiles. In one embodiment, the antenna tiles are individually designed with a custom feed distribution network such that the overall shading pattern across the phased array antenna aperture realizes a desired amplitude level. For example, the plurality of planar array antenna tiles transmits a signal with a shading pattern and each of the plurality of planar array antenna tiles includes a custom power distribution pattern that contributes to the shading pattern.

In a further embodiment, one or more patch antenna elements within a first planar array antenna tile positioned along an exterior portion of planar array antenna are powered by the feed network element at a power level lower than one or more of: patch antenna elements of the first planar array antenna tile positioned closer to an interior of the planar array antenna tile, and the patch antenna elements of a second planar array antenna tile positioned closer to the interior of the planar array antenna than the first planar array antenna tile.

The system includes a planar array antenna having a plurality of planar array antenna tiles, the planar array antenna transmitting a signal with a specific shading pattern, wherein at least one of the plurality of planar array antenna tiles includes a feed-tapered planar array antenna tile. The system also includes a plurality of transmit feed points. Each transmit feed point drives a planar array antenna tile of the plurality of planar array antenna tiles. Each feed-tapered planar array antenna tile includes a plurality of patch antenna elements and a feed network element that distributes power unequally among two or more of the patch antenna elements. The feed network element connects two or more patch antenna elements to a transmit feed point driving the feed-tapered planar array antenna tile.

In some embodiments, the planar array antenna further includes at least one non-tapered planar array antenna tile. The non-tapered planar array antenna tile includes a plurality of patch antenna elements and a transmit feed distribution network that distributes power equally among the patch antenna elements. The transmit feed distribution network connects the plurality of patch antenna elements to a transmit feed point driving a non-tapered planar array antenna tile. In certain embodiments, each of the plurality of planar array antenna tiles includes a custom power distribution pattern that contributes to the shading pattern.

In one embodiment, the feed network element includes a PCB trace comprising a branch feeding each patch antenna element, wherein each branch to a patch antenna element includes a width based on the custom power distribution pattern. In another embodiment, one or more patch antenna elements within a first planar array antenna tile positioned along an exterior portion of planar array antenna are powered by a feed network element for the first planar array antenna tile at a power level lower than patch antenna elements of the first planar array antenna tile positioned closer to an interior of the planar array antenna tile, and/or the patch antenna elements of a second planar array antenna tile positioned closer to the interior of the planar array antenna than the first planar array antenna tile.

In certain embodiments, the feed network element includes a PCB trace, the PCB trace having a first branch connecting a first patch antenna element to the transmit feed point and the second feed branch connecting a second patch antenna elements to the transmit feed point, where a width of the first branch is greater than a width of the second branch. In some embodiments, the feed network element distributes transmit power at a first power level to one or more interior elements and at a second power level to one or more edge elements. The first power level is greater than the second power level.

Another apparatus includes a planar array antenna tile having a plurality of patch antenna elements, wherein the plurality of patch antenna elements includes a plurality of patch elements and at least one interior element. The apparatus also includes a transmit feed point that drives the antenna tile. The apparatus further includes a PCB trace that distributes power unequally among two or more of the patch antenna elements. The PCB trace has a first branch connecting the at least one interior element to the transmit feed point and a second branch connecting an edge element of the plurality of edge elements to the transmit feed point, where a width of the first branch is greater than a width of the second branch.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1:
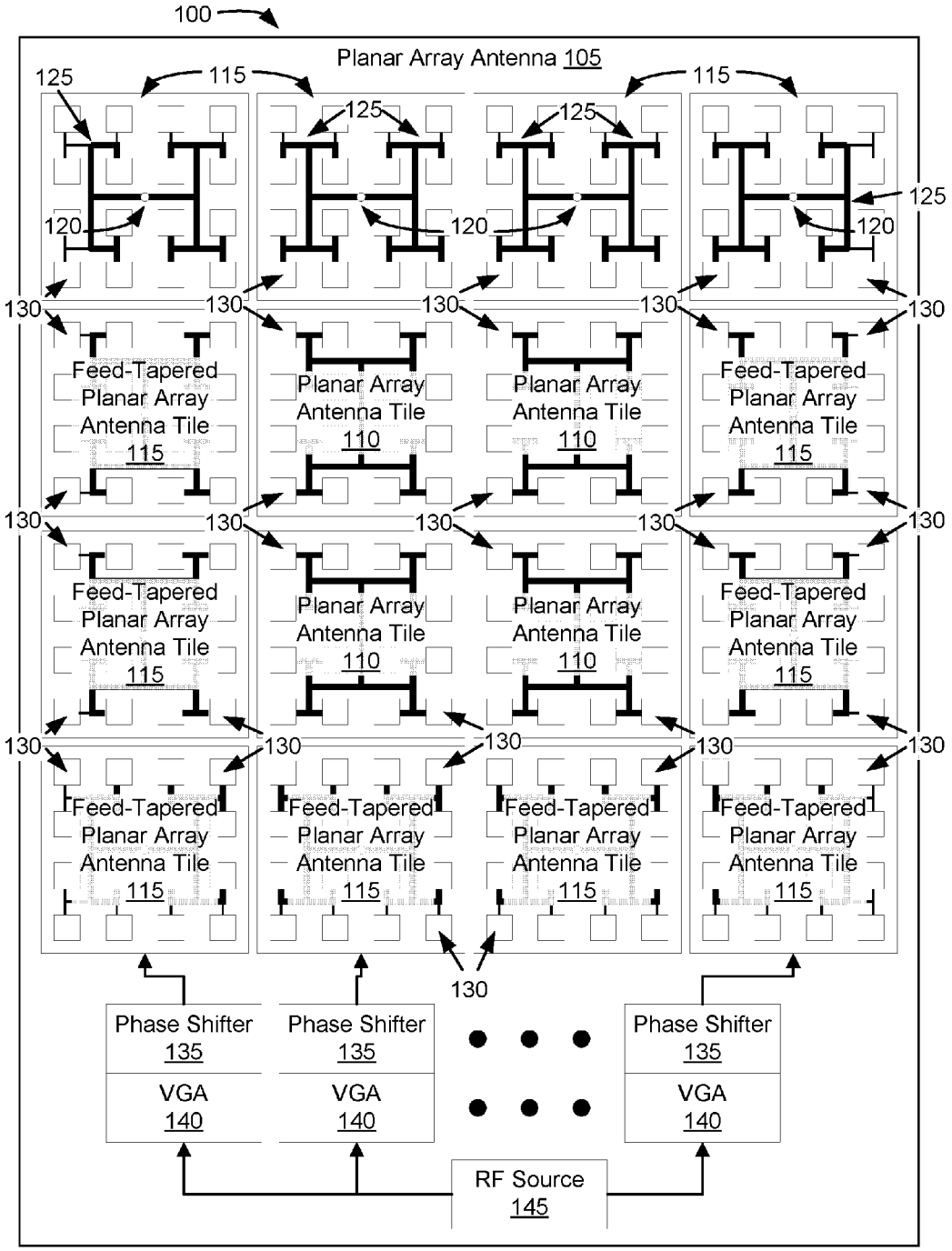
FIG. 1 is a schematic block diagram illustrating one embodiment of a system for phased array aperture shading for sidelobe reduction.

As will be appreciated by one skilled in the art, aspects of the embodiments may be embodied as an apparatus, a system, or the like.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided, such as examples of antenna elements, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

The description of elements in each figure may refer to elements of proceeding figures. Like numbers refer to like elements in all figures, including alternate embodiments of like elements.

For transmit/receive ("Tx/Rx") satellite transceivers that receive downlink signals and transmit uplink signals, the key performance requirements are high sensitivity or gain divided by system noise temperature ("G/T") for the receive antenna and high equivalent isotropic radiated power ("EIRP") for the transmit antenna. At the same time, the sidelobes of the transmit antenna radiation pattern must be low enough to comply with regulatory requirements.

The disclosed phased array antenna tiles, and phased array antennas built using the disclosed phased array antenna tiles, may be designed so that the receive and transmit illumination shading across the phased array aperture differently and achieve better performance overall than it is possible for a traditional reflector antenna. On the transmit site, shading may be needed to achieve a required sidelobe pattern mask. For the receive side, since the phased array aperture faces the sky, shading is typically not needed, as spillover noise for an aperture that faces the sky much smaller than for a feed that faces a dish and looks toward warm ground.

Thus, the whole phased array antenna may include transmit and receive feed distribution networks that drive elements in the array so that the receive network (e.g., the combination of receive feed distribution networks on each antenna tile) provides uniform illumination and the transmit network (e.g., the combination of transmit feed distribution networks on each antenna tile) shades the illumination across the phased array aperture. This achieves a higher sensitivity with a phased array on the receive side than would be possible with a reflector antenna, since shading is not required for the phased array, while still shading the transmit side and thereby meeting the low transmit radiation pattern sidelobe requirement.

To achieve a non-shaded receive illumination pattern and a shaded transmit pattern, the phased array antenna is designed to have a receive feed distribution network that illuminates all elements in the array equally. This uniform illumination pattern is known to maximize gain, and when the array faces the sky and spillover noise is not a significant issue, this also maximizes sensitivity ("G/T").

For the transmit side, the feed distribution network is designed to taper the illumination pattern by exciting edge elements in the array at a lower amplitude than elements in the interior of the array. This may be done by using unequal power splitters in the feed distribution network to distribute less power to edge elements and more power to interior elements. Alternatively, one or more of the edge elements may simply be disconnected from the feed distribution network in some embodiments. The excitation of disconnected elements is small but typically nonzero, due to parasitic coupling from nearby excited elements.

In one embodiment, one row of edge elements in the phased array antenna may be under-illuminated (e.g., due to uneven power distribution in the transmit feed distribution network). In another embodiment, (e.g., for larger arrays) two or more rows of edge elements may be under-illuminated as needed to meet the sidelobe requirement. Precise determination of the excitations needed, in one embodiment, may be determined using electromagnetic modeling of the phased array antenna and its resulting radiation pattern, and adjusting the excitations to achieve sidelobes that meet the required pattern mask or radiation pattern, while maintaining as high a gain in the main beam direction as possible, to maximize the equivalent isotropic radiated power ("EIRP").

A phased array antenna tile for achieving high sensitivity for a phased array receiver simultaneously with low sidelobes of the transmit side of the array is disclosed. The phased array antenna tile may be a part of a phased array antenna, the phased array antenna including a plurality of phased array antenna tiles. In one embodiment, the phased array antenna tile uses an equal-power feed distribution network for the receive array elements, and an unequal-power feed distribution network for the transmit array elements, thus achieving edge-tapering for the transmit side of the array. Notably, different tapering for the transmit and receive sides of a phased array antenna achieves higher receive sensitivity while complying with regulatory transmit sidelobe requirements.

Figure 6:
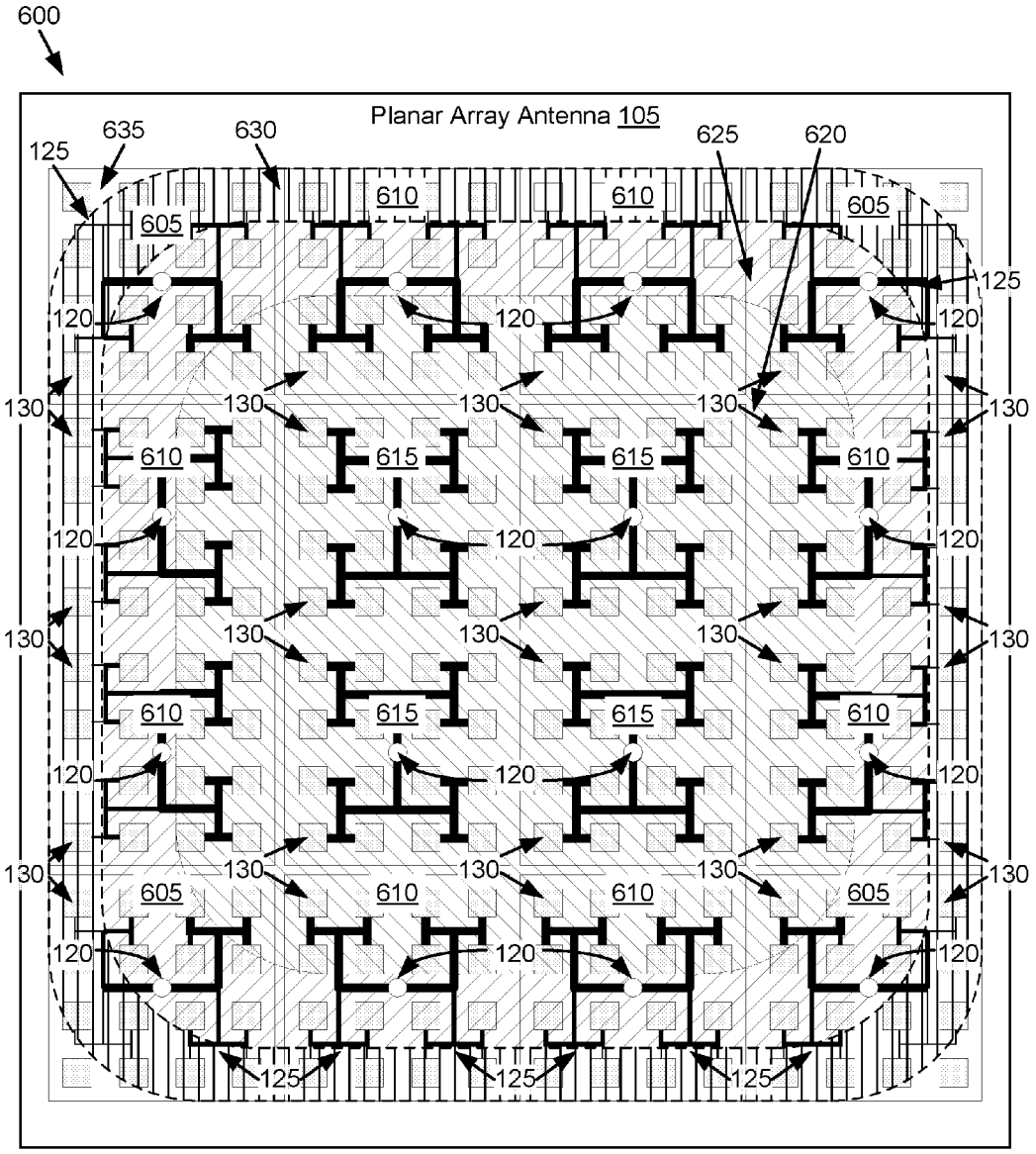
FIG. 6 is a schematic block diagram illustrating one embodiment of a shading pattern used for phased array aperture shading for sidelobe reduction.
Figure 7:
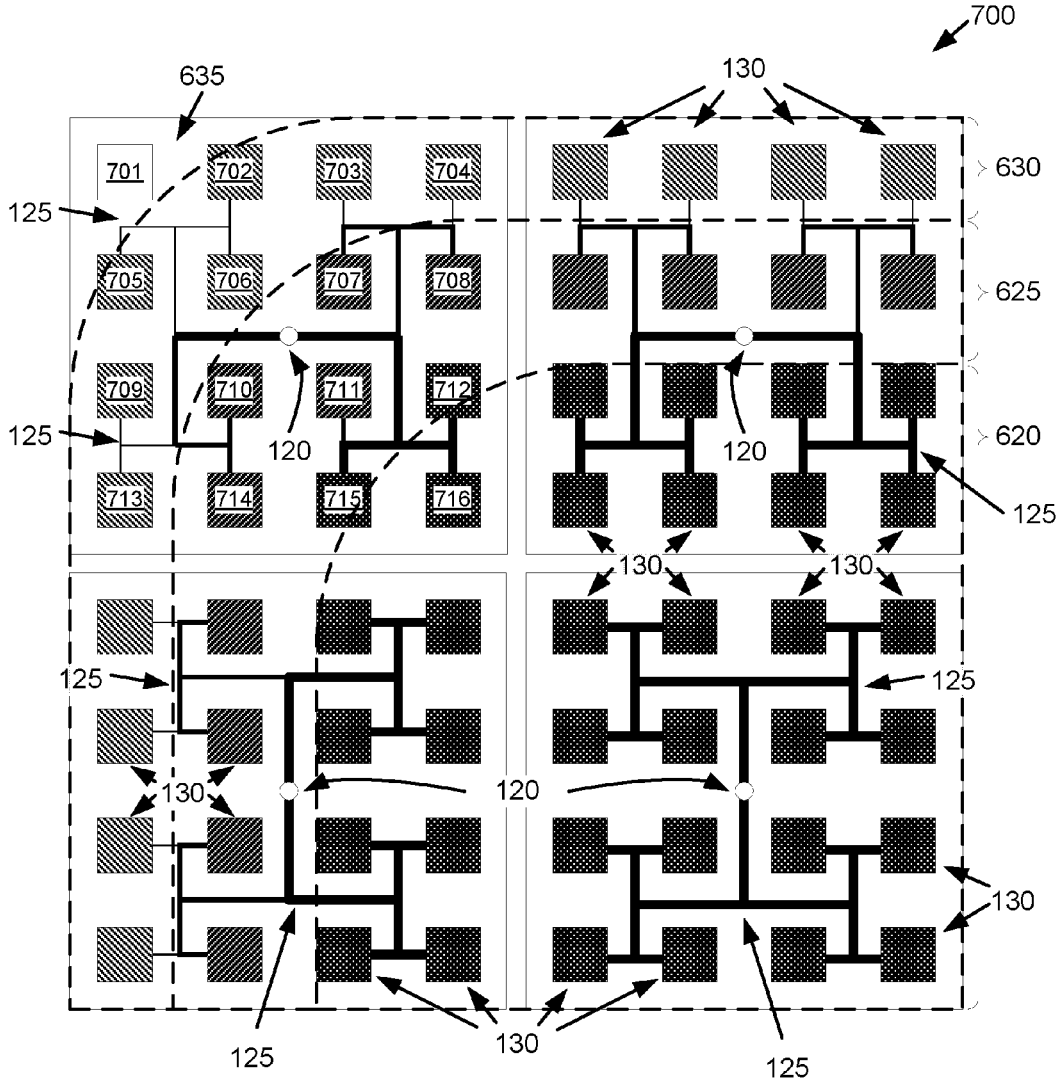
FIG. 7 is a schematic block diagram illustrating one embodiment of a group of antenna tiles implementing the shading pattern of FIG. 7.
Figure 8:
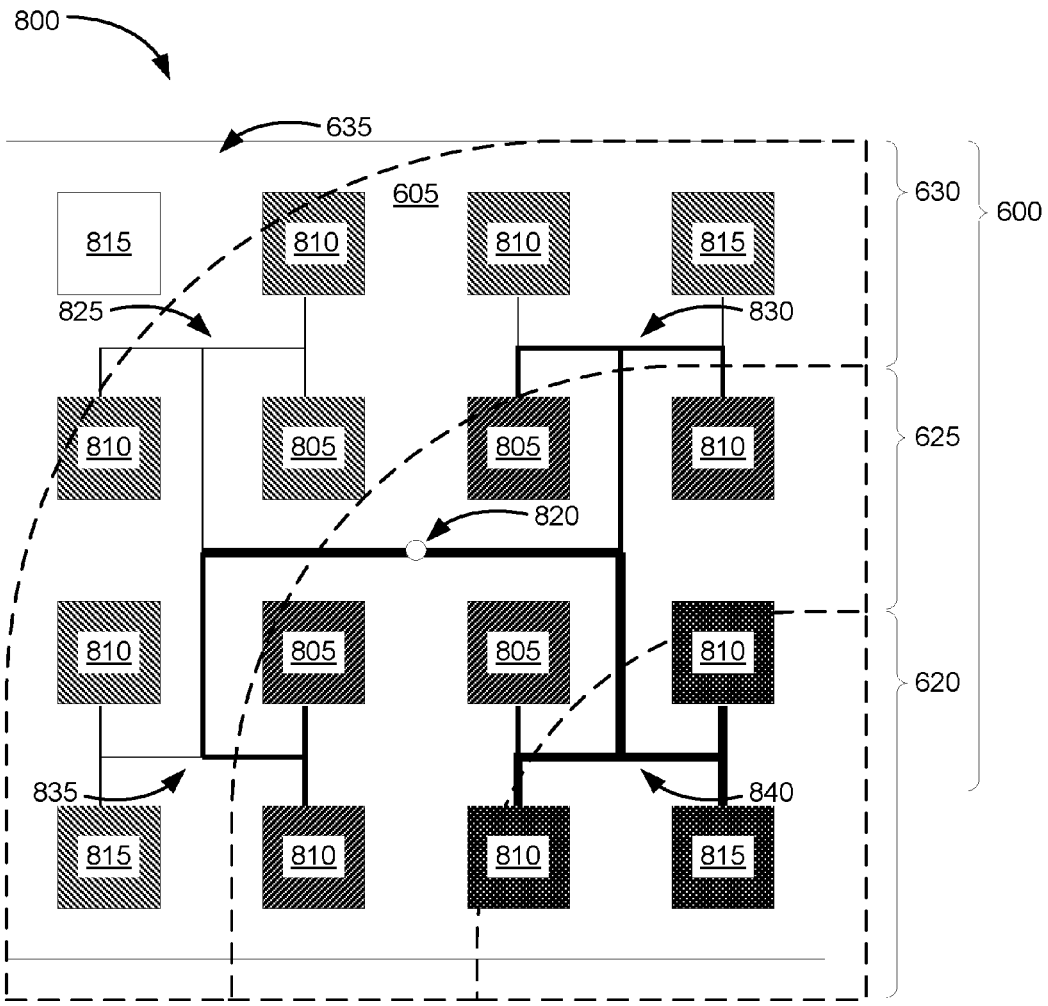
FIG. 8 is a schematic block diagram illustrating one embodiment of a custom power distribution pattern for a single planar array antenna tile.

FIG. 1 depicts a system 100 for satellite communications using phased array aperture shading for sidelobe reduction, according to embodiments of the disclosure. The system 100 includes a planar array antenna 105. The planar array antenna 105 includes a plurality of planar array antenna tiles 110. The planar array antenna 105 transmits a signal with a specific shading pattern. In one embodiment, each of the planar array antenna tiles 110 has a plurality of patch antenna elements 130 that implement a custom power distribution pattern, the power distribution pattern contributing to the shading pattern. An embodiment of a shading pattern that produces a specific radiation pattern is shown at FIG. 6. An embodiment of custom power distribution patterns for a set of planar array antenna tiles 110 is shown at FIG. 7. An embodiment of a custom power distribution pattern for a single planar array antenna tile 110 is shown in FIG. 8.

As used herein, a power distribution pattern refers to the distribution of transmit power to each of the plurality of patch antenna elements 130 by way of a plurality of feed network elements 125 within each planar array antenna tile 110. The feed network elements 125 form at least a portion of a feed distribution network of a planar array antenna tile 110. In some embodiments, additional branch feeder elements join feed network elements 125 to form the feed distribution network of a planar array antenna tile 110. A portion of an overall power distribution pattern for the planar array antenna 105 is implemented on each planar array antenna tile 110 by the feed distribution network of the planar array antenna tile 110, such that each patch antenna element 130 is fed an amount of power based on a desired overall shading pattern. The power distribution pattern refers to power distribution over the feed distribution network (composed of feed network elements 125), while the shading pattern refers to the excitation pattern of the patch antenna elements 130.

As used herein, a shading pattern refers to a target amplitude level for the patch antenna elements 130 across the planar array antenna 105 aperture. The antenna aperture is the effective area of the planar array antenna 105. For the phased array antenna 105, the aperture is the area encompassing the patch antenna elements 130. The overall shading pattern is the amplitude distribution of the transmit signals across the full planar array antenna 105, or in different words, across the aperture. For a reflector dish antenna, the amplitude of the dish illumination near the rim of the dish is tapered to a small value. For the phased array antenna, reducing the driving strengths of edge elements in the array realizes the same effect at the edges of the planar array antenna 105, which may be a square aperture.

Accordingly, the shading pattern is the pattern of the amplitudes of the driving signals fed to each patch antenna element 130 across the array aperture needed for the phased array antenna 105 to form a desired radiation pattern with low sidelobes. The shading pattern is implemented by a feed distribution network (e.g., composed of the feed elements 125) that splits power unequally among the patch antenna elements 130 so that each antenna element has a driving amplitude level as indicated by the shading pattern.

At least one of the plurality of planar array antenna tiles 110 includes a feed-tapered planar array antenna tile 115. The planar array antenna 105 also includes a plurality of transmit feed points 120, each transmit feed point 120 driving one of the planar array antenna tiles 110. The transmit feed points 120 each receive an RF transmit signal from a phase shifter 135 via a feed line. The phase shifters 135 control the phase of the RF transmit signals fed to the planar array antenna tiles 110 via the feed line. In one embodiment, each phase shifter 135 is connected to a frequency source, such as a radio frequency ("RF") source 145, via a variable gain amplifier ("VGA") 140.

The planar array antenna 105 includes a plurality of VGAs 140, each VGA 140 controlling the amplitude of RF transmit signals generated by the RF source 145. In the depicted embodiment, the VGAs 140 feed amplified RF transmit signals to the phase shifters 135. In other embodiments, the VGAs 140 may be placed after the phase shifters 135, such that a RF transmit signal generated by the RF source 145 is first modified by a phase shifter 135 before being amplified by a VGA 140. In certain embodiments, one VGA 140 may amplify the RF transmit signal by a different amount than another VGA in the system 100 such that one planar array antenna tile 110 receives the RF transmit signal at a different magnitude (amplitude) than another planar array antenna tile 110.

Each of the planar array antenna tiles 110 includes a transmit feed distribution network and a receive feed distribution network. In some embodiments, the transmit feed distribution network may be decoupled from the receives feed distribution network. For example, in one embodiment the transmit feed distribution network may be configured to distribute power unequally among the patch antenna elements 130 of a planar array antenna tile 110, so as to implement illumination tapering on the transmit side. However, the same planar array antenna tile 110 may have a receive feed distribution network configured to distribute power equally among the patch antenna elements 130, thereby implementing full illumination (e.g., no tapering) on the receive side. In such embodiments, the planar array antenna tile achieves a higher sensitivity on the receive side than would be possible using a conventional reflector antenna, while still shading the transmit side and thereby meeting the low transmit radiation pattern sidelobe requirement. As satellite communication uses different frequencies for the transmit site than for the receive side, this band-selective phased array aperture shading of the planar array antenna tile 110 maximizes receiver gain/sensitivity while still meeting regulatory sidelobe requirements.

While FIG. 1 depicts a specific number of planar array antenna tiles 110 and feed-tapered planar array antenna tiles 115, the disclosure is not to be limited to the specific numbers shown. Indeed, the planar array antenna 105 may include any number of planar array antenna tiles 110 including any number of feed-tapered planar array antenna tiles 115. Further, while FIG. 1 depicts a specific arrangement of planar array antenna tiles 110 (including an arrangement of the feed-tapered planar array antenna tiles 115 the disclosure is not to be limited to the specific arrangement shown. Indeed, the planar array antenna tiles 110 may be arranged in any manner in order to form the planar array antenna 105. Accordingly, FIG. 1 illustrates one non-limiting example of a system 100 with band-selective aperture shading for sidelobe reduction in Tx/Rx phased array satellite communications transceivers.

Each feed-tapered planar array antenna tile 115 includes a plurality of patch antenna elements 130. Each feed-tapered planar array antenna tile 115 also includes at least one feed network element 125 that distributes power unequally among two or more of the patch antenna elements 130. The feed network element 125 connects the two or more patch antenna elements 130 to a transmit feed point 120 driving the feed-tapered planar array antenna tile 115. The feed network elements 125 may contain unequal power splitters used distribute power unequally among patch antenna elements 130. Exemplary feed-tapered planar array antenna tiles 115 are shown at the top row of planar array antenna tiles 110 in FIG. 1.

As depicted, the feed network elements 125 are transmission lines connecting patch antenna elements 130 to transmit feed points 120 for each feed-tapered planar array antenna tile 115. In one embodiment, the feed network elements 125 include PCB traces. In order to split power unequally among the patch antenna elements 130, in one embodiment, the feed network elements 125 may include PCB traces of different impedances. For example, different PCB traces may have different widths in order to achieve different characteristic impendences. In other embodiments, other physical attributes of the PCB traces are varied to produce different impedances of feed network elements 125 and/or other parts of a power distribution network of a planar array antenna tile 110 to customize power delivery to the patch antenna elements 130 of a planar array antenna tile 110. For simplicity, the feed networks elements 125 are displayed with different widths in the figures while one of skill in the art will recognize that various physical traits of PCB traces may be manipulated to achieve desired power levels. In the depicted embodiment, the feed network elements 125 comprise a plurality of H-tree antenna feed elements. Here, each branch of the H-tree may have a different impedance (e.g., different wave impedance and/or characteristic impedance) the other branches, in order to distribute power to the patch antenna elements 130 at a different power level than the other branches of the H-tree.

As shown, some patch antenna elements 130 are connected to the transmit feed points 120 with PCB traces that are wider than those connecting other patch antenna elements 130. For example, a first PCB trace having a first width may connect a first patch antenna element 130 to the transmit feed point 120 while a second PCB trace having a second width (e.g., less than the width of the first PCB trace) may connect a second patch antenna element 130 to the transmit feed point 120. Power is split between the traces in a ratio that is controlled by the characteristic and/or wave impedances of the transmission lines comprised by the traces. The characteristic impedance of a transmission line (e.g., a PCB trace), in some embodiments, is influenced by the line width, substrate material, and to a lesser degree the thickness. In some embodiments, the PCB traces may be designed with different shapes to achieve different impedance levels.

While FIG. 1 shows PCB traces width as the mechanism for distributing power unequally among the patch antenna elements 130, other embodiments may use different mechanisms for distributing power unequally among the patch antenna elements 130. In one embodiment, PCB traces height (e.g., thickness) may be used as a mechanism for distributing power unequally. For example, PCB traces of equal width but of different height may be used to distribute different levels of transmit power to the patch antenna elements 130. Accordingly, a PCB trace of greater height may have a lower impedance (e.g., wave impedance and/or characteristic impedance) and therefore deliver more power to a patch antenna element 130 than would a PCB trace of lesser height.

In another embodiment, power may be distributed unequally by using PCB traces of same dimension (e.g., height and width), but of different material. For example, a feed network element 125 may include PCB trace using materials of different impedance to distribute the power unequally among the patch antenna elements 130. Accordingly, a material of higher impedance may be used to distribute a lower level of transmit power to one patch antenna element 130 while a material of lower impedance may be used to distribute a higher level of transmit power to another patch antenna element 130. Further, a plurality of materials having different impedances may be used to distribute a plurality of transmit power levels to the patch antenna elements 130.

In yet another embodiment, power may be distributed unequally through the feed network element by insertion of an impedance element in a PCB trace. Accordingly, impedance elements may be used to select an amount of power distributed to a patch antenna element 130. Further, impedance elements of different impedance values (e.g., different wave impedance and/or characteristic impedance values) may be used to achieve a plurality of transmit power levels distributed to the patch antenna elements 130.

In some embodiments, the planar array antenna 105 may also include at least one non-tapered planar array antenna tile. As used herein, a non-tapered planar array antenna tile refers to a planar array antenna tile 110 that distributes power equally among all the patch antenna elements 130 of the antenna tile. Accordingly, a non-tapered planar array antenna tile does not use illumination tapering (also referred to as shading). In contrast, the feed-tapered planar array antenna tiles 115 implement illumination tapering by distributing power unequally among the patch antenna elements 130 of the antenna tile.

In certain embodiments, the planar array antenna 105 may realize a first layer of transmit-side illumination shading from the unequal power distribution at the planar array antenna tiles 110 and realize as second layer of transmit-side illumination shading by the VGAs 140 amplifying the RF transmit signal to a planar array antenna tile 110 by varying amounts. Each VGA 140 may amplify the RF transmit signal by an amount based on a location of a planar array antenna tile 110 within the planar array antenna 105. For example, the planar array antenna tiles 110 located at a perimeter of the planar array antenna 105 may receive RF transmit signals amplified by a lower amount than planar array antenna tiles 110 located at an interior of the planar array antenna 105.

In some embodiments, the VGAs 140 may dynamically adjust the illumination shading of the planar array antenna 105. Unlike the feed network elements 125 which are manufactured to a specific design resulting in a fixed power split (and fixed amount of illumination taper), the VGAs 140 can provide an adjustable amount of illumination shading for the planar array antenna 105. Accordingly, the planar array antenna 105 may dynamically adjust the overall illumination shading (and thus its radiation pattern) of the planar array antenna 105 while in operation by the VGAs 140 adjusting the amplification of the RF transmit signals on an antenna tile basis. Thus, the VGAs 140 can be used as an additional, on-the-fly controllable layer of illumination shading in addition to the fixed power split of the planar array antenna tiles 110.

Figure 2:
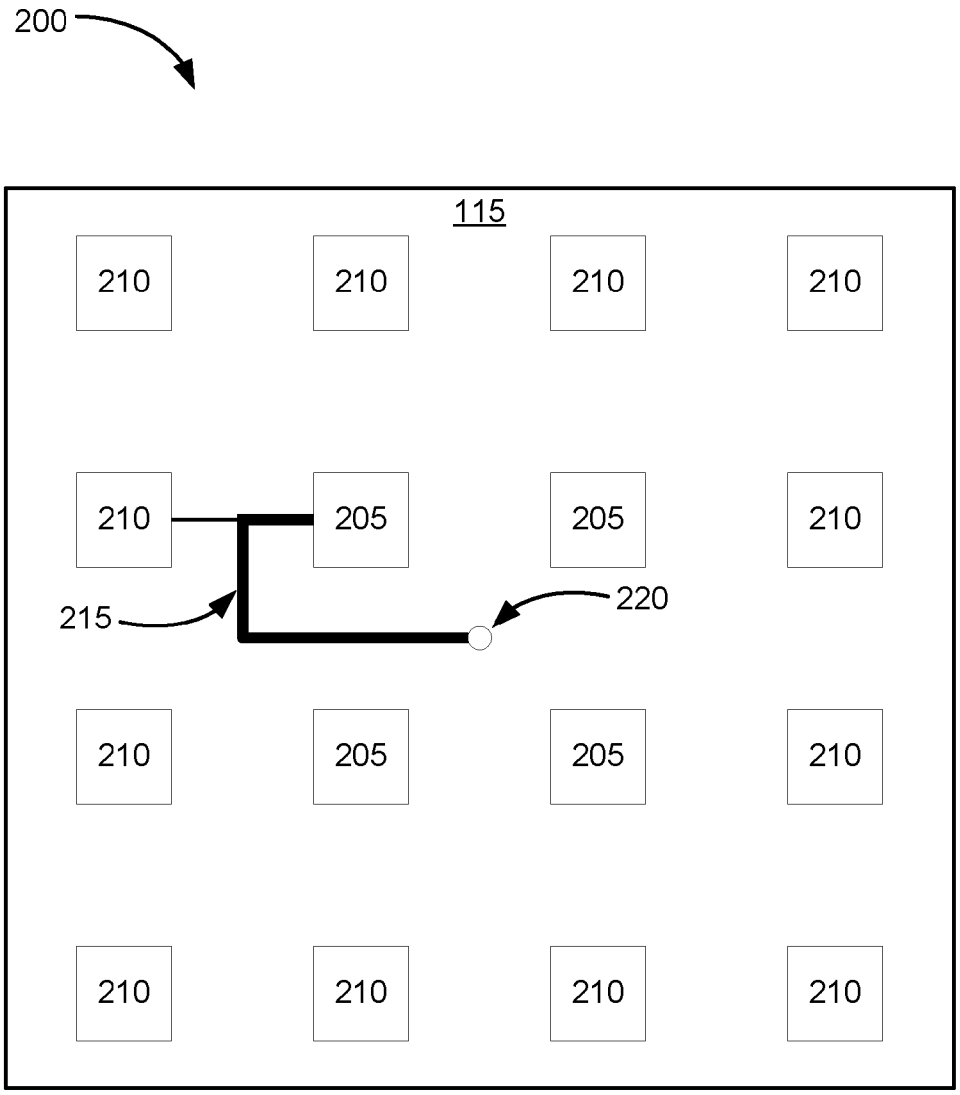
FIG. 2 is a schematic block diagram illustrating one embodiment of an antenna tile used for phased array aperture shading for sidelobe reduction.

FIG. 2 depicts an apparatus 200 for phased array aperture shading for sidelobe reduction, according to embodiments of the disclosure. The apparatus 200 includes one embodiment of a feed-tapered planar array antenna tile 115. The feed-tapered planar array antenna tile 115 includes a plurality of patch antenna elements (e.g. patch antenna elements 130). In some embodiments, the plurality of patch antenna elements includes a plurality of interior elements 205 and a plurality of edge elements 210. As depicted, the feed-tapered planar array antenna tile 115 may include sixteen (16) patch antenna elements may be arranged into a 4×4 grid, with four (4) interior elements 205 located in the middle of the feed-tapered planar array antenna tile 115 and twelve (12) edge elements 210 located along the perimeter of the feed-tapered planar array antenna tile 115.

The feed-tapered planar array antenna tile 115 also includes a feed network element 215 which connects at least two of the plurality of patch antenna elements (e.g. interior elements 205 and exterior elements 210) to a transmit feed point 220. The transmit feed point 220 receives a transmit signal (e.g., from a phase shifter 135) and distributes the transmit signal to the patch antenna elements 205, 210. The patch antenna elements 205, 210 radiate the transmit signal. The feed-tapered planar array antenna tile 115 may include additional antenna components (e.g., power amplifier, phase shifter, receive feed distribution network, receive feed point), which are not depicted here for clarity of illustration.

The feed network element 215 connects at least two patch antenna elements the transmit feed point 220. The feed network element 215 distributes power unevenly among the at least two patch antenna elements. As depicted, the feed network element 215 connects to both an interior element 205 and to an edge element 210, wherein different levels of power are distributed to the patch antenna elements 205, 210. In one embodiment, the feed network element 215 includes an unequal power splitter for distributing power unequally among the two or more patch antenna elements.

In one embodiment, the unequal power splitter may include a potentiometer or other adjustable power splitter. Using an adjustable power splitter allows the power distribution pattern of the feed-tapered planar array antenna tile 115 to be customized after deployment. However, adjustable power splitters can be relatively expensive. Thus, in other embodiments, the unequal power splitter may be a PCB trace or other nonadjustable power splitter. The PCB trace power splitters are implemented for a predetermined power distribution pattern and are typically low cost and are usually easy to manufacture.

In some embodiments, the feed network element 215 includes a first PCB trace (or a first branch of a PCB trace) connecting a first patch antenna element (e.g., an interior element 205) to the transmit feed point 220 and a second PCB trace (or a second branch of the PCB trace) connecting a second patch antenna element (e.g., an edge element 210) to the transmit feed point 220. The different PCB traces (or different branches of the PCB trace) have different physical characteristics so as to unevenly distribute power to the interior element 205 and the edge element 210. For example, the feed network element 215 may distribute transmit power at a first power level to one or more interior elements 205 and distribute transmit power at a second power level to one or more edge elements 210, the first power level being greater than the second power level. Other planar array antenna tiles 115 may include additional power levels to certain patch antenna elements.

In the depicted embodiment, the different PCB traces (or different branches) of the feed network element 215 have different impedances. For example, the impedance of a first branch connecting to the interior element 205 may be greater in the impedance of the second branch connecting to the edge element 210, so as to distribute a greater portion of the transmit power to the interior element 205 than to the edge elements 210. In certain embodiments, the difference impedances are achieved by using PCB traces of different widths and/or heights. In other embodiments, the different PCB traces (or different branches) of the feed network element 215 may be made from different materials having different impedance values or may include impedance elements of different impedance values, thereby distributing power unequally among the interior element 205 and the edge element 210.

In addition, the PCB traces forming the feed network element 215 feeding multiple patch antenna elements may be sized appropriately so that the patch antenna elements (e.g., interior elements 205 and edge elements 210) receive an appropriate amount of power. In one embodiment, a PCB trace having two branches (each branch feeding an antenna element) may be twice the size (e.g., twice the width or twice the height) of the branches going to each patch antenna element, so that the trace doesn't reduce the capacity of the individual branches.

FIG. 2 shows a single feed network element 215 for clarity. However, in one embodiment each of the interior elements 205 and each of the edge elements 210 be connected to the transmit feed point 220 via one or more feed network elements 215. In other embodiments, one or more edge elements 210 may be disconnected from the transmit feed point 220. Even though they are not connected to the transmit feed point, the disconnected edge elements 210 may transmit a nonzero amount of power due to parasitic coupling among the patch antenna elements, thereby contributing to the specific radiation pattern of the planar array antenna 105.

The feed-tapered planar array antenna tile 115 includes at least one transmit feed point 220, each transmit feed point being connected to one phase shifter 135. In some embodiments, the feed-tapered planar array antenna tile 115 has exactly one transmit feed point 220 (e.g., connecting the feed-tapered planar array antenna tile 115 to exactly one phase shifter 135) that distributes a transmit signal to the plurality of patch antenna elements (e.g., interior elements 205 and edge elements 210). However, in other embodiments, the feed-tapered planar array antenna tile 115 includes more than one transmit feed point 220, but less than one transmit feed point 220 per patch antenna element. Accordingly, at least two patch antenna elements 205, 210 receive transmit signal from a single transmit feed point 220 and thus from a single amplifier or phase shifter 135.

While FIG. 2 depicts a specific number of interior elements 205 and edge elements 210, the disclosure is not to be limited to the specific numbers shown. Further, while FIG. 2 depicts a specific arrangement of interior elements 205 and edge elements 210, the disclosure is not to be limited to the specific arrangement shown. Indeed, a feed-tapered planar array antenna tile 115 may include any number of interior elements 205 and edge elements 210 arranged in any manner in order to form the feed-tapered planar array antenna tile 115. Accordingly, FIG. 2 illustrates one non-limiting example of a feed-tapered planar array antenna tile 115 for band-selective aperture shading for sidelobe reduction in Tx/Rx phased array satellite communications transceivers.

Figure 3:
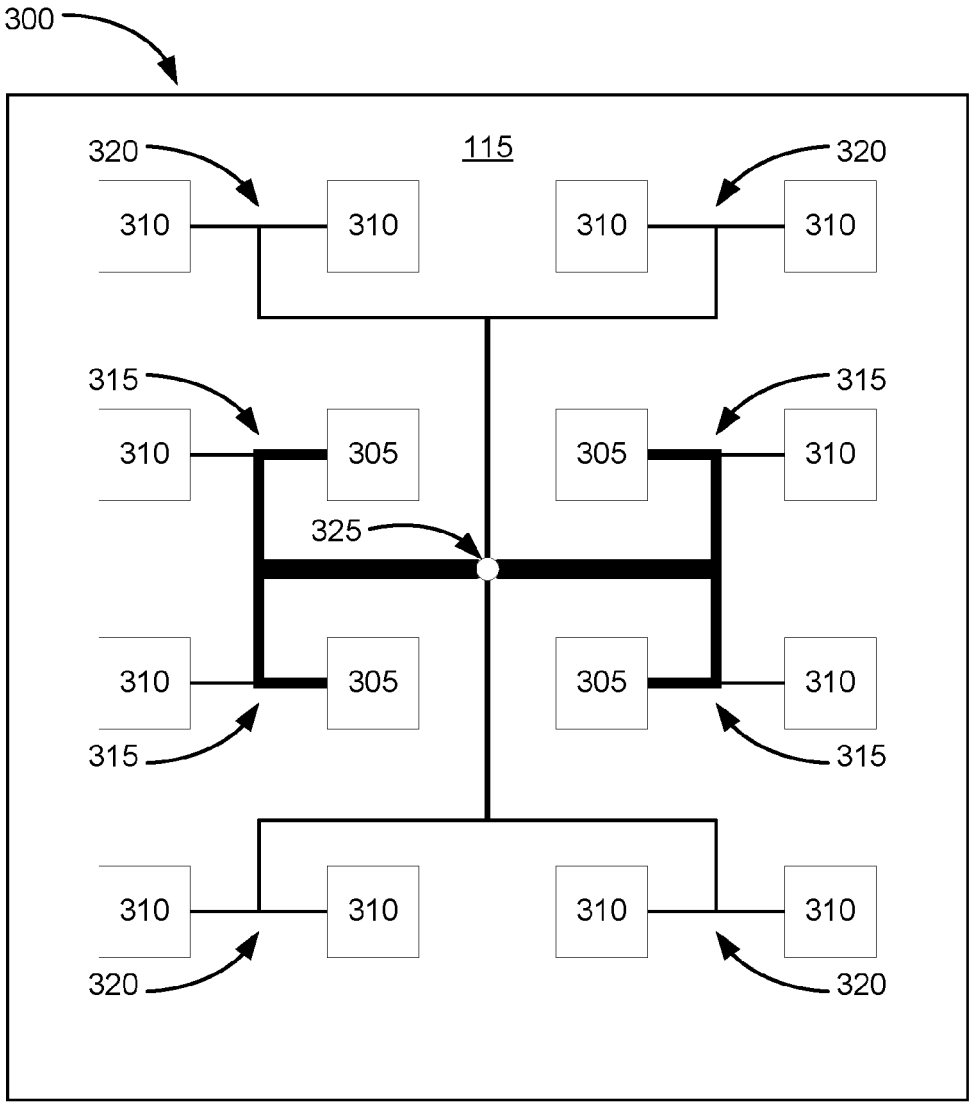
FIG. 3 is a schematic block diagram illustrating a second embodiment of an antenna tile phased array aperture shading for sidelobe reduction.

FIG. 3 depicts an apparatus 300 for phased array aperture shading for sidelobe reduction, according to embodiments of the disclosure. The apparatus 300 includes one embodiment of a feed-tapered planar array antenna tile 115. The feed-tapered planar array antenna tile 115 includes a plurality of patch antenna elements (e.g., patch antenna elements 130). In some embodiments, the plurality of patch antenna elements includes a plurality of interior elements 305 and a plurality of edge elements 310. As depicted, the feed-tapered planar array antenna tile 115 may include sixteen (16) patch antenna elements may be arranged into a 4×4 grid, with four (4) interior elements 305 located in the middle of the feed-tapered planar array antenna tile 115 and twelve (12) edge elements 310 located along the perimeter of the feed-tapered planar array antenna tile 115.

The feed-tapered planar array antenna tile 115 also includes a plurality of feed network elements 315, each of which connects at least two of the plurality of patch antenna elements (e.g., interior elements 305 and edge elements 310) to a transmit feed point 325. The transmit feed point 325 receives a transmit signal (e.g., from a phase shifter 135) and distributes the transmit signal to the patch antenna elements 305, 310. The patch antenna elements 305, 310 radiate the transmit signal. The feed-tapered planar array antenna tile 115 may include additional antenna components (e.g., power amplifier, phase shifter, receive feed distribution network, receive feed point), which are not depicted here for clarity of illustration.

The feed-tapered planar array antenna tile 115 includes at least one transmit feed point 325, each transmit feed point being connected to one phase shifter 135. In some embodiments, the feed-tapered planar array antenna tile 115 has exactly one transmit feed point 325 (e.g., connecting the feed-tapered planar array antenna tile 115 to exactly one phase shifter 135) that distributes a transmit signal to the plurality of patch antenna elements (e.g., interior elements 305 and edge elements 310). However, in other embodiments, the feed-tapered planar array antenna tile 115 includes more than one transmit feed point 325, but less than one transmit feed point 325 per patch antenna element. Accordingly, at least two patch antenna elements 305, 310 receive transmit signal from a single transmit feed point 325 and thus from a single amplifier or phase shifter 135.

Each feed network element 315 connects at least two patch antenna elements to the transmit feed point 325. The feed network elements 315 distribute power unevenly among the connected patch antenna elements. As depicted, each feed network element 315 connects to both an interior element 305 and to an edge element 310, wherein different levels of power are distributed to the patch antenna elements 305, 310.

In one embodiment, each feed network element 315 includes an unequal power splitter for distributing power unequally among the two or more patch antenna elements. As discussed above, examples of unequal power splitters include, but not are not limited to, PCB traces of unequal impedance, PCB traces of unequal width, PCB traces of unequal height, PCB traces made from different materials, potentiometers, adjustable impedance elements, and the like. The unequal power splitter may distribute transmit power at a first power level to one or more interior elements 305 and distribute transmit power at a second power level to one or more edge elements 310, the first power level being greater than the second power level.

In addition, the PCB branch traces forming each feed network element 315 feeding multiple patch antenna elements may be sized appropriately so that the patch antenna elements (e.g., interior elements 305 and edge elements 310) receive an appropriate amount of power. In one embodiment, a PCB trace having two branches (each branch feeding an antenna element) may be twice the size (e.g., twice the width or twice the height) of the branches going to each patch antenna element, so that the trace does not reduce the capacity of the individual branches.

In some embodiments, feed-tapered planar array antenna tile 115 may include one or more equal distribution feed elements 320 which connect at least two patch antenna elements to the transmit feed point, wherein the equal distribution feed elements 320 distribute power equally among the at least two patch antenna elements. In certain embodiments, an equal distribution feed element 320 connected only to edge elements 310 may deliver transmit power at a different (e.g., lower) power level then an equal distribution feed element 320 connected only to interior elements 305. For example, interior elements 305 may be fed power at a first power level, while edge elements 310 may be fed power at a second power level, wherein the first power level is greater than the second power level.

While FIG. 3 depicts a specific number of interior elements 305, edge elements 310, feed network elements 315, equal distribution feed elements 320, and transmit feed points 325, the disclosure is not to be limited to the specific numbers shown. Further, while FIG. 3 depicts a specific arrangement of interior elements 305, edge elements 310, feed network elements 315, equal distribution feed elements 320, and transmit feed point 325, the disclosure is not to be limited to the specific arrangement shown. Indeed, a feed-tapered planar array antenna tile 115 may include any number and arrangement of interior elements 305, edge elements 310, feed network elements 315, equal distribution feed elements 320, and transmit feed point 325, in order to produce a specific shading pattern. Accordingly, FIG. 3 illustrates one non-limiting example of a feed-tapered planar array antenna tile 115 for band-selective aperture shading for sidelobe reduction in Tx/Rx phased array satellite communications transceivers.

Figure 4:
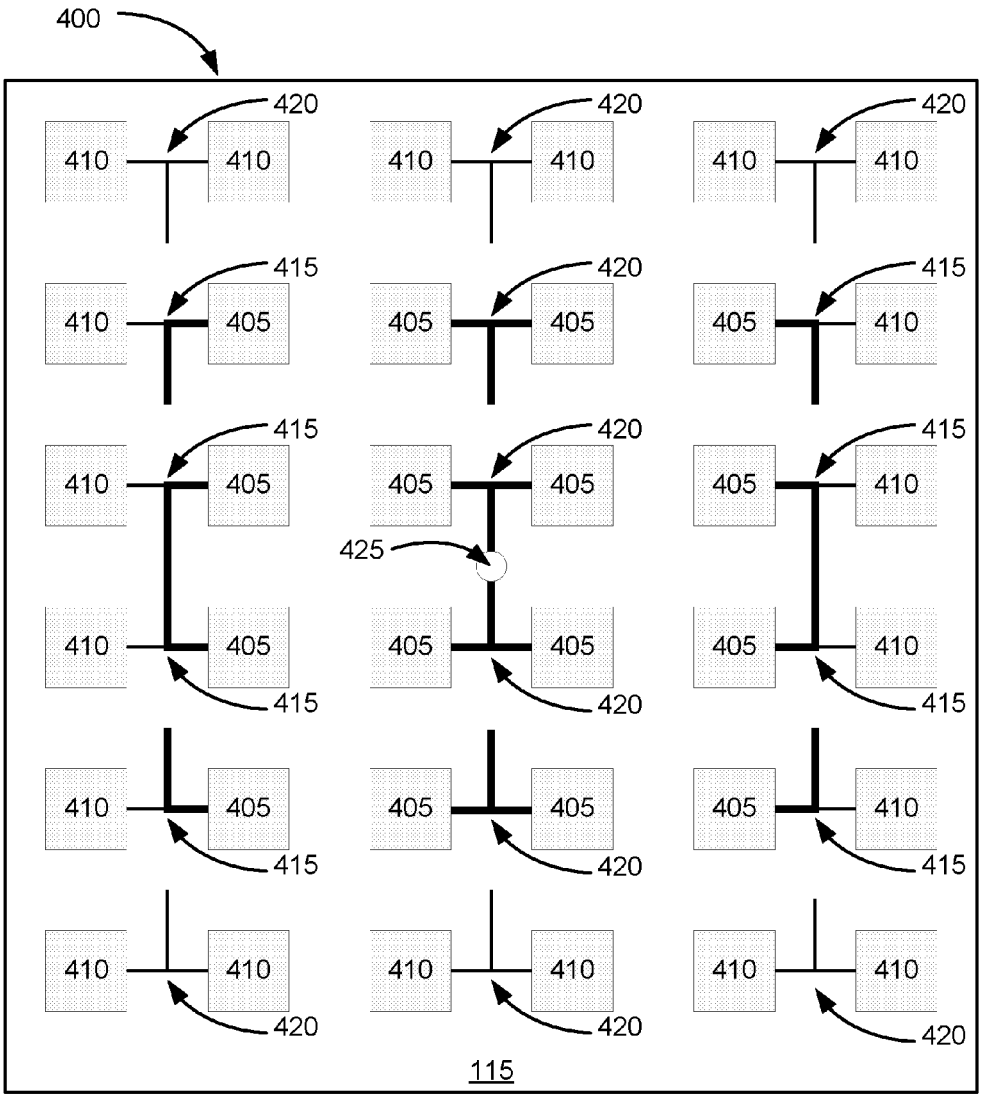
FIG. 4 is a schematic block diagram illustrating a third embodiment of an antenna tile used for phased array shading for sidelobe reduction.

FIG. 4 depicts an apparatus 400 for phased array aperture shading for sidelobe reduction, according to embodiments of the disclosure. The apparatus 400 includes one embodiment of a feed-tapered planar array antenna tile 115. The feed-tapered planar array antenna tile 115 includes a plurality of patch antenna elements (e.g. patch antenna elements 130). In some embodiments, the plurality of patch antenna elements includes a plurality of interior elements 405 and a plurality of edge elements 410. As depicted, the feed-tapered planar array antenna tile 115 may include thirty-six (36) patch antenna elements may be arranged into a 6×6 grid, with sixteen (16) interior elements 405 located in the middle of the feed-tapered planar array antenna tile 115 and twenty (20) edge elements 410 located along the perimeter of the feed-tapered planar array antenna tile 115.

The feed-tapered planar array antenna tile 115 also includes a plurality of feed network elements 415, each of which connects at least two of the plurality of patch antenna elements 405, 410 to a transmit feed point 425. The transmit feed point 425 receives a transmit signal (e.g., from a phase shifter 135) and distributes the transmit signal to the patch antenna elements 405, 410. The patch antenna elements 405, 410 radiate the transmit signal. The feed-tapered planar array antenna tile 115 may include additional antenna components (e.g., power amplifier, phase shifter, receive feed distribution network, receive feed point), which are not depicted here for clarity of illustration.

Each feed network element 415 connects at least two patch antenna elements to a single transmit feed point 425. The feed network elements 415 distribute power unevenly among the connected patch antenna elements. As depicted, each feed network element 415 connects to both an interior element 405 and to an edge element 410, wherein different levels of power are distributed to the patch antenna elements 405, 410.

In one embodiment, each feed network element 415 includes an unequal power splitter for distributing power unequally among the two or more patch antenna elements. As discussed above, examples of unequal power splitters include, but not are not limited to, PCB traces of unequal impedance, PCB traces of unequal width, PCB traces of unequal height, PCB traces made from different materials, potentiometers, adjustable impedance elements, and the like. The unequal power splitter may distribute transmit power at a first power level to one or more interior elements 405 and distribute transmit power at a second power level to one or more edge elements 410, the first power level being greater than the second power level.

In addition, the PCB traces forming the feed network element 415 feeding multiple patch antenna elements may be sized appropriately so that the patch antenna elements (e.g., interior elements 405 and edge elements 410) receive an appropriate amount of power. In one embodiment, a PCB trace having two branches (each branch feeding an antenna element) may be twice the size (e.g., twice the width or twice the height) of the branches going to each patch antenna element, so that the trace doesn't reduce the capacity of the individual branches.

In some embodiments, the feed-tapered planar array antenna tile 115 may include one or more equal distribution feed elements 420 which connect at least two patch antenna elements to the transmit feed point, wherein the equal distribution feed elements 420 distribute power equally among the at least two patch antenna elements. The plurality of feed network elements 415 and equal distribution feed elements 420 form a feed distribution network (not shown for clarity) connecting the patch antenna elements 405, 410 to a single feed point 425. The feed-tapered planar array antenna tile 115 includes at least one transmit feed point 425, each transmit feed point 425 being connected to one phase shifter 135.

In some embodiments, the feed-tapered planar array antenna tile 115 has exactly one transmit feed point 425 (e.g., connecting the feed-tapered planar array antenna tile 115 to exactly one phase shifter 135) that distributes a transmit signal to the plurality of patch antenna elements (e.g., interior elements 405 and edge elements 410). However, in other embodiments, the feed-tapered planar array antenna tile 115 includes more than one transmit feed point 425, but less than one transmit feed point 425 per patch antenna element. Accordingly, at least two patch antenna elements 305, 310 receive transmit signal from a single transmit feed point 425 and thus from a single amplifier or phase shifter 135.

In certain embodiments, an equal distribution feed element 420 connected only to edge elements 410 may deliver transmit power at a different (e.g., lower) power level then an equal distribution feed element 420 connected only to interior elements 405. For example, interior elements 405 may be fed power at a first power level, while edge elements 410 may be fed power at a second power level, wherein the first power level is greater than the second power level.

As depicted, the feed-tapered planar array antenna tile 115 under-illuminates (e.g., due to the unequal power distribution) one "row" of patch antenna elements. In other embodiments, the feed-tapered planar array antenna tile 115 may under-illuminate two (or more) rows of patch antenna elements in order to produce a specific radiation pattern that meets regulatory sidelobe requirements. In one embodiment, the feed-tapered planar array antenna tile 115 under-illuminates the smallest number of patch antenna elements (e.g., edge elements 410) needed to meet the regulatory sidelobe requirements, thereby maximizing the gain of the feed-tapered planar array antenna tile 115.

While FIG. 4 depicts a specific number of interior elements 405, edge elements 410, feed network elements 415, and equal distribution feed elements 420, the disclosure is not to be limited to the specific numbers shown. Further, while FIG. 4 depicts a specific arrangement of interior elements 405, edge elements 410, feed network elements 415, and equal distribution feed elements 420, the disclosure is not to be limited to the specific arrangement shown. Indeed, a feed-tapered planar array antenna tile 115 may include any number and arrangement of interior elements 405, edge elements 410, feed network elements 415, and equal distribution feed elements 420, in order to produce a specific shading pattern. Accordingly, FIG. 4 illustrates one non-limiting example of a feed-tapered planar array antenna tile 115 for band-selective aperture shading for sidelobe reduction in Tx/Rx phased array satellite communications transceivers.

Figure 5:
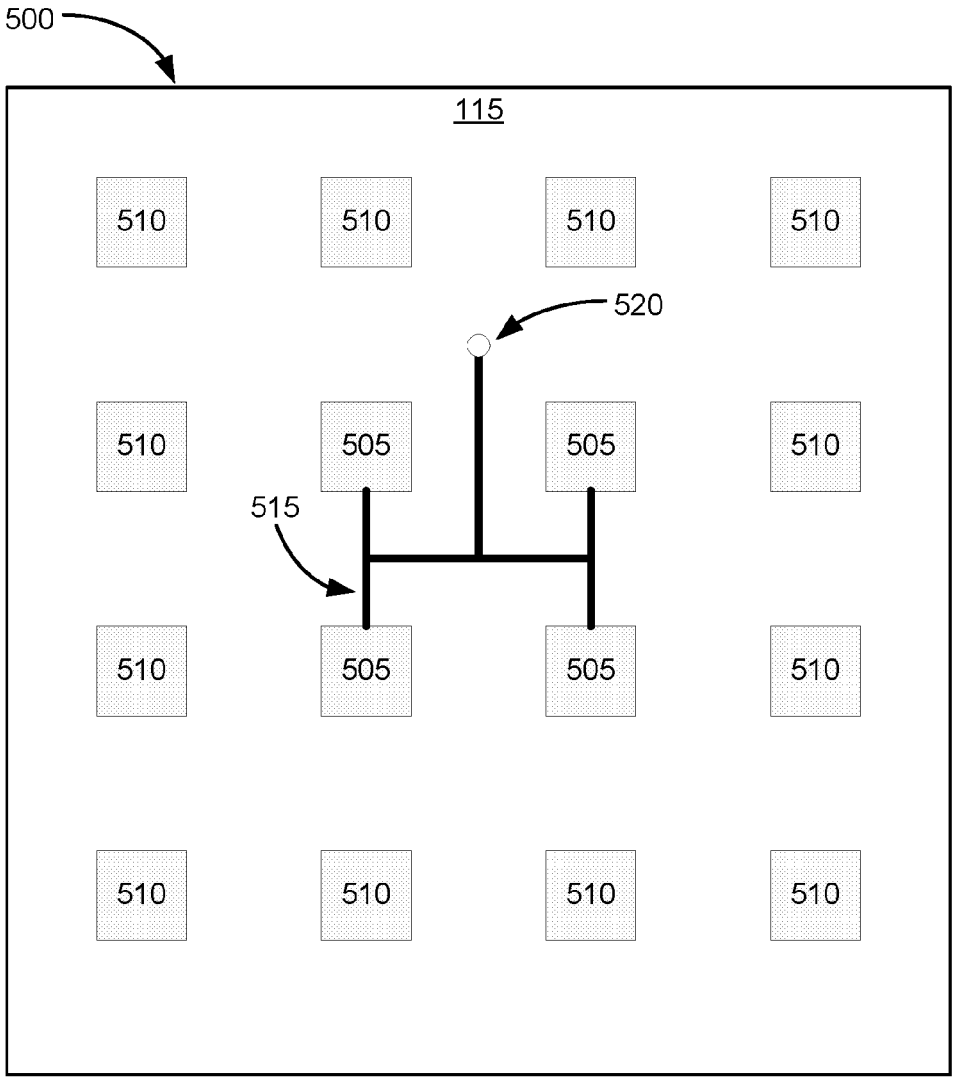
FIG. 5 is a schematic block diagram illustrating a fourth embodiment of an antenna tile used for phased array aperture shading for sidelobe reduction.

FIG. 5 depicts an apparatus 500 for phased array aperture shading for sidelobe reduction, according to embodiments of the disclosure. The apparatus 500 includes one embodiment of a feed-tapered planar array antenna tile 115. The feed-tapered planar array antenna tile 115 includes a plurality of patch antenna elements (e.g. patch antenna elements 130). In some embodiments, the plurality of patch antenna elements includes a plurality of interior elements 505 and a plurality of edge elements 510. As depicted, the feed-tapered planar array antenna tile 115 may include sixteen (16) patch antenna elements may be arranged into a 4×4 grid, with four (4) interior elements 505 located in the middle of the feed-tapered planar array antenna tile 115 and twelve (12) edge elements 510 located along the perimeter of the feed-tapered planar array antenna tile 115.

The feed-tapered planar array antenna tile 115 also includes a feed distribution network tree 515, here an H-tree antenna feed, which connects at least two of the plurality of patch antenna elements to a transmit feed point 520. The transmit feed point 520 receives a transmit signal (e.g., from a phase shifter 135) and distributes the transmit signal to the patch antenna elements 505, 510, which radiate the transmit signal. The feed-tapered planar array antenna tile 115 may include additional antenna components (e.g., power amplifier, phase shifter, receive feed distribution network, receive feed point), which are not depicted here for clarity of illustration.

As depicted, the feed distribution network tree 515 connects at least two interior elements 505 the transmit feed point 520. In the apparatus 500, the edge elements 510 are not directly connected to the transmit feed point 520. However, parasitic coupling between the edge elements 510 and the interior elements 505 cause the edge elements 510 to radiate a non-zero amount of power. As the apparatus 500 drives the interior elements 505 at full amplitude, the edge elements 510 are driven parasitically. Accordingly, the feed-tapered planar array antenna tile 115 emits a transmit signal with a specific shading pattern where the interior elements 505 and the edge elements 510 contribute to the specific shading pattern.

The feed-tapered planar array antenna tile 115 includes at least one transmit feed point 520, each transmit feed point being connected to one phase shifter 135. In some embodiments, the feed-tapered planar array antenna tile 115 has exactly one transmit feed point 520 (e.g., connecting the feed-tapered planar array antenna tile 115 to exactly one phase shifter 135) which distributes a transmit signal to the plurality of interior elements 505. However, in other embodiments, the feed-tapered planar array antenna tile 115 includes more than one transmit feed point 520, but no more than one transmit feed point 520 (and corresponding phase shifter 135) per interior element 505.

As the apparatus 500 distributes power unevenly among the patch antenna elements (e.g., delivering a first power level to the interior elements 505 and a second power level to the edge elements 510), it exhibits illumination tapering of the transmit signal. In some embodiments, the apparatus 500 may drive only a portion of the edge elements via parasitic coupling (the other edge elements 510 being connected directly to the transmit feed point 520). For example, a minimum number of edge elements 510 may be disconnected from the transmit feed point 520, so as meet the regulatory sidelobe requirements while maximizing the gain of the feed-tapered planar array antenna tile 115.

In order to distribute power evenly among the interior elements 505, the feed distribution network tree 515 may connect to each interior element with a PCB trace branch having a same width. In addition, the PCB traces forming the feed distribution network tree 515 feeding multiple interior elements 505 may be sized appropriately so that each interior elements 205 receives an equal amount of power. In one embodiment, a PCB trace having two branches (each branch feeding an antenna element) may be twice the size (e.g., twice the width or twice the height) of the branches going to each patch antenna element, so that the trace doesn't reduce the capacity of the individual branches.

While FIG. 5 depicts a specific number of interior elements 505 and edge elements 510, the disclosure is not to be limited to the specific numbers shown. Further, while FIG. 5 depicts a specific arrangement of interior elements 505 and edge elements 510, the disclosure is not to be limited to the specific arrangement shown. Indeed, a feed-tapered planar array antenna tile 115 may include any number of interior elements 505 and edge elements 510 arranged in any manner in order to form the feed-tapered planar array antenna tile 115. Accordingly, FIG. 5 illustrates one non-limiting example of a feed-tapered planar array antenna tile 115 for band-selective aperture shading for sidelobe reduction in Tx/Rx phased array satellite communications transceivers.

FIG. 6 depicts a shading pattern 600 for phased array aperture shading for sidelobe reduction, according to embodiments of the disclosure. The shading pattern 600, in one embodiment, is an overall shading pattern representing a design goal or requirement for forming a beam during transmission where some patch antenna elements 130 operate at a reduced power level to meet side lobe requirements.

The shading pattern 600 may be used for one embodiment of a planar array antenna 105 to define power distribution requirements (e.g., a power distribution pattern) for each patch antenna element 130 of the planar array antenna 105. The power distribution requirements are implemented using a plurality of feed network elements 125. The planar array antenna 105, in the depicted embodiment, includes sixteen (16) planar array antenna tiles arranged into a 4×4 grid. The planar array antenna tiles include four corner antenna tiles 605 located at the four corners of the grid, eight edge antenna tiles 610 located along the perimeter of the grid, and four interior antenna tiles 615 located at the center of the grid. While a specific number and arrangement of planar array antenna tiles are shown, in other embodiments other numbers and/or arrangements of planar array antenna tiles may be used.

The shading pattern 600 is a template to help create a radiation pattern that meets regulatory sidelobe requirements or design goals by using illumination tapering to shape the radiation pattern of the planar array antenna 105. In one embodiment, the shading pattern 600 is achieved using custom power distribution patterns on each planar array antenna tile 110 of the planar array antenna 105. In another embodiment, the shading pattern 600 is achieved using both the custom power distribution patterns on each antenna tile as well as different levels amplification of the RF signal fed to each planar array antenna tile 110 of the planar array antenna 105, for example using the VGAs 140.

As depicted, the shading pattern 600 includes a first power level zone 620, a second power level zone 625, and a third power level zone 630. The first power level zone 620 indicates regions of the planar array antenna tiles 605-615 that are to be driven at a first transmit power level, the second power level zone 625 indicates regions of the planar array antenna tiles 605-615 that are to be driven at a second transmit power level, and the third power level zone 630 indicates regions of the planar array antenna tiles 605-615 that are to be driven at a third transmit power level.

The first transmit power level is greater than the second transmit power level and the second transmit power level is greater than the third transmit power level. In one example, the first transmit power level may correspond to a full amplitude of the transmit signal (e.g., 100% of the full amplitude level), the second transmit power level may correspond to 60% of the full amplitude level, and the third transmit power level may correspond to 20% of the full amplitude level. Additionally, the shading pattern 600 indicates an unpowered zone 635 corresponding to regions of the planar array antenna tiles 605-615 to be driven only parasitically.

Patch antenna elements 130 of the planar array antenna tiles 605-615 are connected to transmit feed points 120 via feed network elements 125, each set of feed network elements 125 located on a planar array antenna tile 605-615 forming a transmit feed distribution network. Where different patch antenna elements 130 of the planar array antenna tiles 605-615 are located in different power level zones 620-630, feed network elements 125 having unequal power splitters may be used to distribute power unequally among two or more of the patch antenna elements 130.

Each planar array antenna tile 605-615 includes at least one transmit feed point 120, each transmit feed point 120 being connected to one phase shifter 135. In some embodiments, the planar array antenna tile 605-615 has exactly one transmit feed point 120 (e.g., connecting the planar array antenna tile 605-615 to exactly one phase shifter 135) that distributes a transmit signal to the plurality of patch antenna elements 130, to maximize cost savings of the planar array antenna 105. However, in other embodiments, the planar array antenna tiles 605-615 may include more than one transmit feed point 120, but no more than one transmit feed point 120 per patch antenna element 130. Accordingly, at least two patch antenna elements 130 receive transmit signal from a single transmit feed point 120 and thus from a single amplifier or phase shifter 135.

In some embodiments, the unequal power splitters may include PCB traces having different branches with different impedances (e.g., due to different widths or heights). The impedance of the PCB trace branch may correspond to the power level zone 620-635 in which a patch antenna element 130 is located. Accordingly, patch antenna elements 130 located in the first power level zone 620 may be connected to a PCB trace branch having a first impedance, patch antenna elements 130 located in the second power level zone 625 may be connected to a PCB trace branch having a second impedance, and patch antenna elements 130 located in the third power level zone 630 may be connected to a PCB trace branch having a third impedance. The first impedance is greater than the second impedance and the second impedance is greater than the third impedance, so as to distribute transmit power at a first power level to patch antenna elements 130 within the first power level zone 620, at a second power level to patch antenna elements 130 within the second power level zone 625, and at a third power level to patch antenna elements 130 within the third power level zone 630.

As depicted, PCB traces forming the feed network elements 125 extend from each transmit feed point 120 to a plurality of patch antenna elements 130. The PCB traces branch at certain points to feed different patch antenna elements 130 (or groups of patch antenna elements 130). Each PCB trace and PCB trace branch may be sized according to the amount of power to be delivered to the patch antenna elements 130, so that the patch antenna elements 130 receive the proper amount of power. Here, the impedance of the PCB trace controls the amount of power fed to each patch antenna element 130, so each PCB trace branch will be sized so as to have the characteristic impedance needed for proper power delivery.

For example, a PCB trace that feeds two patch antenna elements 130 may be larger than the PCB traces between a split point and each patch antenna element 130. Similarly, a PCB trace that feeds four patch antenna elements 130 may be bigger than a PCB trace that feeds two patch antenna elements 130, etc. In one embodiment, each PCB trace branch is to be sized based on the power levels of the branch to achieve proper power levels at each patch antenna element 130. In another embodiment, the PCB traces may be oversized and include a resistive/impedance element calculated to deliver the proper power levels at each patch antenna element 130. In this case, a last PCB trace branch feeding a patch antenna element 130 may have a particular size, but all PCB traces ahead of this branch are sized so that impedance of the aggregate PCB trace is insignificant with respect to this last branch.

In one embodiment, one or more patch antenna elements 130 in the corner antenna tiles 605 and/or the edge antenna tiles 610 (e.g., the antenna tiles positioned along an exterior portion of the planar array antenna 105) are powered by a feed network element 125 at a power level lower than patch antenna elements 130 within the same a planar array antenna tile that are positioned closer to an interior of the planar array antenna tile. In another embodiment, one or more patch antenna elements 130 in the corner antenna tiles 605 and/or the edge antenna tiles 610 (e.g., the antenna tiles positioned along an exterior portion of the planar array antenna 105) are powered by a feed network element 125 at a power level lower than patch antenna elements 130 of another planar array antenna tile that is positioned closer to the interior of the planar array antenna 105 (e.g., an interior antenna tile 615).

FIG. 7 depicts a set 700 of planar array antenna tiles for phased array aperture shading for sidelobe reduction, according to embodiments of the disclosure. The set 700 of power array antenna tiles implements the shading pattern 600 discussed above in relation to FIG. 6. The set 700 of planar array antenna tiles includes a corner antenna tile 605, two edge antenna tiles 610, and an interior antenna tile 615. Each antenna tile 605-615 in the set 700 of planar array antenna tiles includes a plurality of patch antenna elements 130. The plurality of patch antenna elements 130 may be connected to a transmit feed point 120 via a plurality of feed network elements 125.

As discussed above, each planar array antenna tile 605-615 includes one transmit feed point 120, each transmit feed point 120 being connected to one phase shifter 135. The plurality of patch network elements 130 formed on each planar array antenna tile 605-615 are connected to a corresponding transmit feed point 120 on that planar array antenna tile via one or more feed network elements 125. The set of feed network elements 125 on each planar array antenna tile 605-615 forms a transmit feed distribution network for that planar array antenna tile.

Each planar array antenna tile 605-615 in the set 700 of planar array antenna tiles implements a custom power distribution pattern that contributes to the shading pattern of a planar array antenna 105 comprising the set 700 of planar array antenna tiles. The feed distribution networks for each planar array antenna tile implement a power distribution pattern. Here, the interior antenna tile 615 is located entirely within the first power level zone 620. A portion of the corner antenna tile 605 and each edge antenna tile 610 is located within the first power level zone 620. Another portion of the corner antenna tile 605 and each edge antenna tile 610 is located within the second power level zone 625. Another portion of the corner antenna tile 605 and each edge antenna tile 610 is located within the third power level zone 630. Additionally, a portion of the corner antenna tile 605 is located in the unpowered zone 635.

Each of the plurality of patch antenna elements 130 in the interior antenna tile 615 is driven at the same transmit power level (e.g., the first power level), as every patch antenna element 130 of the interior antenna tile 615 is located within the first power level zone 620. Thus, the interior antenna tile 615 includes a transmit feed distribution network (e.g., a set of feed network elements 125) that distributes power equally among the plurality of patch antenna elements 130 of the interior antenna tile 615. Accordingly, the interior antenna tile 615 is not illumination tapered. In one embodiment, the interior antenna tile 615 is a non-tapered planar array antenna tile.

The corner antenna tile 605 includes a plurality of patch antenna elements 701-716. A first subset of patch antenna elements in the corner antenna tile 605 are located in the first power level zone (e.g., patch antenna elements 712, 715, and 716) and are thus driven at the first power level. A second subset of patch antenna elements in the corner antenna tile 605 are located in the second power level zone (e.g., patch antenna elements 707, 708, 710, 711, and 714) and are thus driven at the second power level. A third subset of patch antenna elements in the corner antenna tile 605 are located in the third power level zone (e.g., patch antenna elements 702-706, 709, and 713) and are thus driven at the third power level. Additionally, patch antenna element 701 is located in the unpowered zone 635 and is thus driven parasitically (e.g., patch antenna element 701 is not connected to the transmit feed point 120 via a feed network element 125).

The corner antenna tile 605 includes a plurality of PCB traces (e.g., feed network elements 125) leading from a transmit feed point 120 to the patch antenna elements 702-716. As depicted, the PCB traces leading to the first subset of patch antenna elements (e.g., patch antenna elements 712, 715, and 716) has a greater width (corresponding to a lower impedance) than the PCB traces leading to the second subset of patch antenna elements (e.g., patch antenna elements 707, 708, 710, 711, and 714). Further, the PCB traces leading to the second subset of patch antenna elements have a greater width (corresponding to a lower impedance) than the PCB traces leading to the third subset of patch antenna elements (e.g., patch antenna elements 702-706, 709, and 713).

As also depicted, there are no PCB traces leading to the patch antenna element 701 that is located in the unpowered zone 635. Thus, the transmit feed distribution network of the corner antenna tile 605 distributes power unequally among the plurality of patch antenna elements 701-716, wherein the power level distributed to a patch antenna element corresponds to a power level zone in which the patch antenna element is located.

Each edge antenna tile 610 also includes a plurality of patch antenna elements 130. A first subset of patch antenna elements in each edge antenna tile 610 are located in the first power level zone (e.g., the lower two rows of patch antenna elements 130 of the rightmost edge antenna tile 610) and are thus driven at the first power level. A second subset of patch antenna elements 130 in the corner antenna tile 605 are located in the second power level zone (e.g., the second row from the top of patch antenna elements 130 of the rightmost edge antenna tile 610) and are thus driven at the second power level. A third subset of patch antenna elements 130 in the corner antenna tile 605 are located in the third power level zone (e.g., the topmost row of patch antenna elements 130 of the rightmost edge antenna tile 610) and are thus driven at the third power level. Neither of the edge antenna tiles 610 have any patch antenna elements 130 located in the unpowered zone 635.

Accordingly, each edge antenna tile 610 includes a plurality of PCB traces (e.g., feed network elements 125) leading from a transmit feed point 120 to each of the patch antenna elements 130. As depicted, the PCB traces leading to the first subset of patch antenna elements 130 has a greater width (corresponding to a lower impedance) than the PCB traces leading to the second subset of patch antenna elements 130. Further, the PCB traces leading to the second subset of patch antenna elements 130 have a greater width (corresponding to a lower impedance) than the PCB traces leading to the third subset of patch antenna elements 130. Thus, the transmit feed distribution networks of the edge antenna tiles 610 distribute power unequally among the plurality of patch antenna elements 130, wherein the power level distributed to a patch antenna element 130 corresponds to a power level zone in which the patch antenna element 130 is located.

While the interior antenna tile 615 is depicted as not implementing illumination tapering, in other embodiments an interior antenna tile 615 may implement illumination tapering by distributing power unequally among two or more of the patch antenna elements 130. Specifically, where the shading pattern 600 includes a greater number of power levels, one or more patch antenna elements 130 of an interior antenna tile 615 may be located in a different power level zone than other patch antenna elements 130 of the interior antenna tile 615. In such embodiments, the interior antenna tile 615 may include one or more feed network elements 125 that distributes power unequally among two or more of the patch antenna elements 130.

FIG. 8 depicts an apparatus 800 for phased array aperture shading for sidelobe reduction, according to embodiments of the disclosure. The apparatus 800 includes one embodiment of a corner antenna tile 605, discussed above in relation to FIGS. 6 and 7. The corner antenna tile 605 may be a component of the planar array antenna (e.g., planar array antenna 105) that includes a plurality of planar array antenna tiles (e.g., planar array antenna tiles 605-615). The planar array antenna comprising the corner antenna tile 605 may transmit a specific radiation pattern, where each planar array antenna tile in the planar array antenna implements a custom power distribution pattern for contributing to the shading pattern.

Here, the corner antenna tile 605 implements the shading pattern 600 discussed above with reference to FIGS. 6 and 7, including a first power level zone 620, a second power level zone 625, a third power level zone 630, and an unpowered zone 635. The corner antenna tile 605 includes a plurality of patch antenna elements, including a plurality of interior elements 805 and a plurality of edge elements 810. As depicted, the plurality of patch antenna elements may also include a plurality of corner elements 815. Note that the interior elements 805, edge elements 810, and corner elements 815 are defined by their location with respect to the corner antenna tile 605, rather than their location within the greater planar array antenna.

The corner antenna tile 605 also includes a plurality of feed network elements 825-840, each of which connects at least two of the plurality of patch antenna elements 805-815 to a transmit feed point 820. The transmit feed point 820 receives a transmit signal (e.g., from a phase shifter 135) and distributes the transmit signal to the patch antenna elements 805-815. The patch antenna elements 805-815 radiate the transmit signal. The corner antenna tile 605 may include additional antenna components (e.g., power amplifier, phase shifter, receive feed distribution network, receive feed point), which are not depicted here for clarity of illustration. As discussed above, the corner antenna tile 605 includes one transmit feed point 820, each transmit feed point 820 being connected to one phase shifter 135.

The feed network elements 825-840 distribute power at three discrete power levels: full, medium, and low. In one embodiment, the full power level corresponds to 100% of the full amplitude of the transmit signal, the medium power level corresponds to 50% of the full amplitude of the transmit signal, and the low power level corresponds to 20% of the full amplitude of the transmit signal. The specific power level distributed to the connected patch antenna elements may be based on a custom power distribution pattern that implements the shading pattern 600.

The feed network element 825 connects to an interior element 805 and to two edge elements 810. Here, the feed network element 825 distributes power evenly to the connected patch antenna elements, for example due to each of the connected patch antenna elements being located within the same power level zone of the shading pattern 600. The feed network element 825 distribute transmit power at the low power level. The feed network element 825 does not connect the adjacent corner element 815 (corresponding to patch antenna element 701) to the transmit feed point 820 due to the adjacent corner element 815 being located in the unpowered zone of the shading pattern 600. Although not connected to the transmit feed point 820, the corner element 815 radiates a nonzero amount of power due to parasitic coupling.

The feed network element 830 connects one interior element 805, two edge elements 810, and one corner element 815 to the transmit feed point. As depicted, the feed network element 830 distributes power at a first power level to the interior element 805 and one of the edge elements 810. The feed network element 830 also distributes power at a second power level to the corner element 815 and the remaining edge element 810. Here, the feed network element 830 distributes power at the medium power level to the interior element 805 and at the low power level to the corner element 815. The specific power levels may be determined by the shading pattern 600 for the corner antenna tile 605.

The feed network element 835 connects one interior element 805, two edge elements 810, and one corner element 815 to the transmit feed point. As depicted, the feed network element 835 distributes power at a first power level to the interior element 805 and one of the edge elements 810. The feed network element 830 also distributes power at a second power level to the corner element 815 and the remaining edge element 810. Here, the feed network element 835 distributes power at the medium (e.g., second) power level to the interior element 805 and at the low (e.g., third) power level to the corner element 815. The specific power levels may be determined by the shading pattern 600 for the corner antenna tile 605.

The feed network element 840 connects one interior element 805, two edge elements 810, and one corner element 815 to the transmit feed point. As depicted, the feed network element 840 distributes power at a first power level to the corner element 815 and both edge elements 810. The feed network element 840 also distributes power at a second power level to the interior element 805. Here, the feed network element 830 distributes power at the medium power level to the interior element 805 and at the high power level to the corner element 815. The specific power levels may be determined by the shading pattern 600 for the corner antenna tile 605.

As depicted, each of the feed network elements 830-840 distributes power unevenly among the connected patch antenna elements. In one embodiment, each feed network element 830-40 includes an unequal power splitter for distributing power unequally among the two or more patch antenna elements. As discussed above, examples of unequal power splitters include, but not are not limited to, PCB traces of unequal impedance, PCB traces of unequal width, PCB traces of unequal height, PCB traces made from different materials, potentiometers, adjustable impedance elements, and the like.

In addition, the PCB traces forming feed network elements 825-840 may be sized appropriately so that the patch antenna elements 805-815 receive an appropriate amount of power based on the power level zone 620-635. In one embodiment, a PCB trace having two branches (each branch feeding an antenna element) may be twice the size (e.g., twice the width or twice the height) of the branches going to each patch antenna element, so that the trace doesn't reduce the capacity of the individual branches.

As depicted, the corner antenna tile 605 includes a plurality of patch antenna elements (e.g., patch antenna elements 805-815) and a transmit feed point 820 that drives the corner antenna tile 605. The corner antenna tile 605 further includes at least one feed network element that distributes power unequally among two more of the patch antenna elements, the feed network element connecting the two or more patch antenna elements to the transmit feed point. The feed network elements which distribute power unequally (e.g., feed network elements 830-840) may each include one or more unequal power splitters. In one embodiment, each unequal power splitter includes a PCB trace, the PCB trace having a first branch connecting a first patch antenna element to the transmit feed to 820 and a second branch connecting a second patch antenna element to the transmit feed to 820. To achieve unequal power distribution among the first and second patch antenna elements, the width of the first branch is greater than the width of the second branch (corresponding to a lower impedance). Accordingly, a greater power level is distributed to the first patch antenna element then to the second patch antenna element.

In certain embodiments, a feed network element distributes transmit power at a first power level to one or more interior elements 805 and at a second power level to one or more edge elements 810 (see, e.g., feed network elements 830-840). In one embodiment, the first power level (e.g., fed to the interior element 805) is greater than the second power level (see, e.g., feed network elements 830-835). In other embodiments, the first power level is less than the second power level (see, e.g., feed network element 840). In some embodiments, a second feed network element may distribute transmit power at the first power level. For example, the feed network element 830 includes a first branch that feeds power at the first power level to the interior element 805 and a second branch that feeds power at this same power level to an edge element 810.

In some embodiments, a feed network element distributes transmit power at third power level to at least one corner element 815. In other embodiments, at least one corner element 815 may be unconnected to the transmit feed point 820. A specific power level distributed to a patch antenna element of the corner antenna tile 605 may be determined based on the shading pattern 600. Further, a specific patch antenna element may be connected to or unconnected to the transmit feed point 820 based on the shading pattern 600.

While FIG. 8 depicts a transmit feed distribution network (e.g., comprising transmit feed point 820 and feed network elements 825-840) that implements illumination tapering (e.g., to create a specific radiation pattern), the corner antenna tile 605 may include a receive feed distribution network connecting the patch antenna elements 805-815 to a receive feed point. In one embodiment, the receive feed distribution network connects (directly) to all of the patch antenna elements and equally illuminates all of the patch antenna elements of the corner antenna tile 605.

Although, FIG. 8 depicts a specific number of interior elements 805, edge elements 810, corner elements 815, and feed network elements 825-840, the disclosure is not to be limited to the specific numbers shown. Further, while FIG. 8 depicts a specific arrangement of interior elements 805, edge elements 810, corner elements 815, and feed network elements 825-840, the disclosure is not to be limited to the specific arrangement shown. Indeed, a corner antenna tile 605 may include any number and arrangement of interior elements 805, edge elements 810, corner elements 815, and feed network elements 825-840. Accordingly, FIG. 8 illustrates one non-limiting example of a feed-tapered planar array antenna tile 115 for band-selective aperture shading for sidelobe reduction in Tx/Rx phased array satellite communications transceivers.

Figure 9:
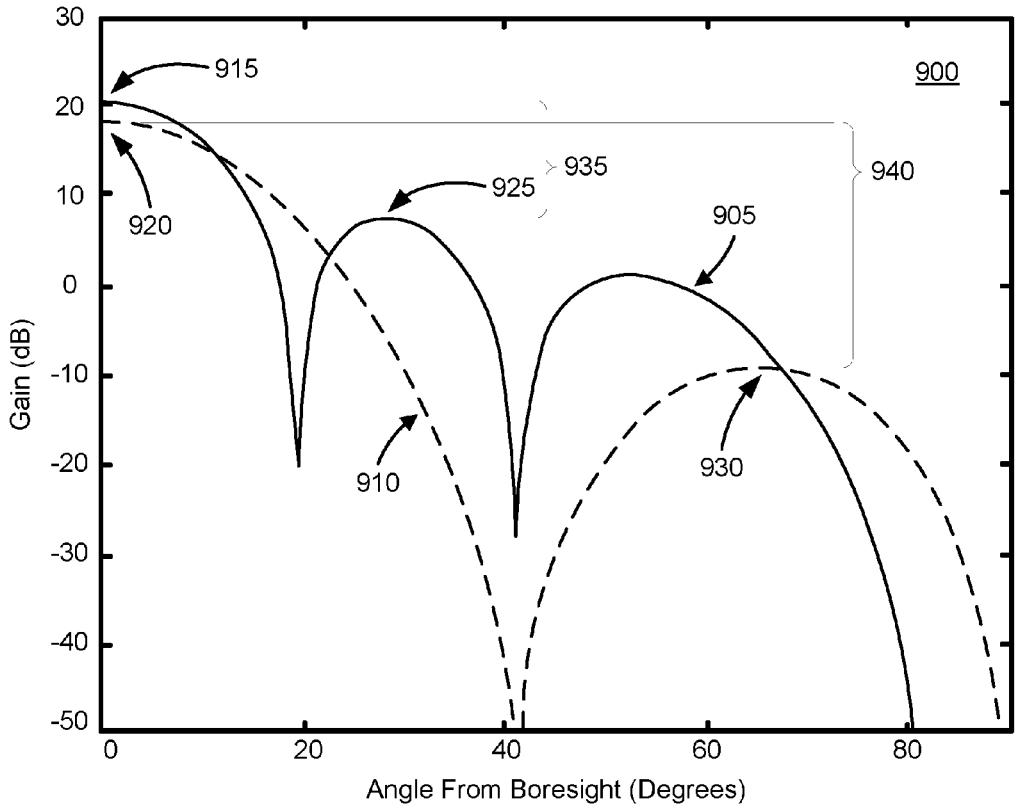
FIG. 9 is a chart diagram illustrating one embodiment of a sidelobe performance of an antenna tile.

FIG. 9 depicts a chart diagram 900 illustrating sidelobe performance of a feed tapered planar array antenna tile, according to embodiments of the invention. The chart diagram 900 shows simulation results a first radiation pattern 905 corresponding to a conventional planar array antenna tile that does not implement illumination tapering. The first radiation pattern 905 shows the mainlobe gain 915 as well as the gain and location of the first sidelobe 925. The difference between the mainlobe gain 915 and the gain of the first sidelobe 925 is referred to as the sidelobe level 935.

The chart diagram 900 also shows a second radiation pattern 910 corresponding to projected results of a feed-tapered planar array antenna tile. The second radiation pattern 910 also shows a projected mainlobe gain 920 as well as the projected gain and location of a first sidelobe 930. The difference between the projected mainlobe gain 920 and the projected gain of the first sidelobe 930 is the projected sidelobe level 940. Here, the second radiation pattern 910 is the radiation pattern for a 16 element array (e.g., in a 4×4 grid) with the 12 patch elements excited at 20% of the amplitude of the four interior elements. The feed tapered planar array antenna tile having the second radiation pattern 910 may be one embodiment of the apparatus 300 discussed above with reference to FIG. 3.

As depicted, the second radiation pattern 910 has a projected mainlobe gain 920 (approximately 17 dB) that is within a few decibels of the projected mainlobe gain 915 of the first radiation pattern 905 (approximately 20 dB). Accordingly, the feed-tapered planar array antenna tile predicts good performance as compared to the conventional planar array antenna tile. Further, the feed-tapered planar array antenna tile predicts significant improvement in sidelobe performance as compared to the conventional planar array antenna tile. As depicted, the second radiation pattern 910 has a projected sidelobe level 940 that is significantly improved over the sidelobe level 935 of the first radiation pattern 905. The second radiation pattern 910 projects a sidelobe level 940 is nearly 20 dB better than the first radiation pattern 905.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a planar array antenna tile having a plurality of patch antenna elements;

a transmit feed point that drives the planar array antenna tile;

a feed network element that distributes power unequally among two or more of the patch antenna elements, wherein the feed network element connects the two or more patch antenna elements to the transmit feed point; and a receive feed distribution network and a receive feed point, the receive feed distribution network connecting the plurality of patch antenna elements to the receive feed point, wherein the receive feed distribution network equally illuminates all patch antenna elements of the tile.

2. The apparatus of claim 1, wherein the feed network element comprises an unequal power splitter.

3. The apparatus of claim 2, wherein the unequal power splitter comprises a printed circuit board ("PCB") trace, the PCB trace having a first branch connecting a first patch antenna element to the transmit feed point and a second branch connecting a second patch antenna element to the transmit feed point, wherein a width of the first branch is greater than a width of the second branch.

4. The apparatus of claim 1, wherein the plurality of patch antenna elements comprises a plurality of interior elements and a plurality of edge elements, wherein the feed network element distributes transmit power at a first power level to one or more interior elements and at a second power level to one or more edge elements, the first power level being greater than the second power level.

5. The apparatus of claim 4, further comprising a second feed element that distributes transmit power to an edge element at the first power level.

6. The apparatus of claim 4, wherein the plurality of patch antenna elements further comprises one or more corner elements, wherein the feed network element distributes transmit power at a third power level to at least one of the one or more corner elements.

7. The apparatus of claim 4, wherein the plurality of patch antenna elements further comprises one or more of corner elements, wherein at least one of the corner elements is unconnected to the transmit feed point.

8. The apparatus of claim 1, wherein the planar array antenna tile is a component of a planar array antenna, the planar array antenna comprising a plurality of planar array antenna tiles.

9. The apparatus of claim 8, wherein the plurality of planar array antenna tiles transmits a signal with a specific shading pattern and each of the plurality of planar array antenna tiles comprises a custom power distribution pattern that contributes to the shading pattern.

10. The apparatus of claim 9, wherein one or more patch antenna elements within a first planar array antenna tile positioned along an exterior portion of the planar array antenna are powered by the feed network element for the first planar array antenna tile at a power level lower than one or more of:

patch antenna elements of the first planar array antenna tile positioned closer to an interior of the planar array antenna tile; and patch antenna elements of a second planar array antenna tile positioned closer to the interior of the planar array antenna than the first planar array antenna tile.

11. A system comprising:

a planar array antenna having a plurality of planar array antenna tiles, the planar array antenna transmitting a signal with a specific shading pattern, wherein at least one of the plurality of planar array antenna tiles comprises a feed-tapered planar array antenna tile; and a plurality of transmit feed points, each transmit feed point driving a planar array antenna tile of the plurality of planar array antenna tiles, wherein each feed-tapered planar array antenna tile comprises:

a plurality of patch antenna elements;

a feed network element that distributes power unequally among two or more of the patch antenna elements, wherein the feed network element connects the two or more patch antenna elements to a transmit feed point driving the feed-tapered planar array antenna tile; and a receive feed distribution network and a receive feed point, the receive feed distribution network connecting the plurality of patch antenna elements to the receive feed point, wherein the receive feed distribution network equally illuminates all patch antenna elements of the tile.

12. The system of claim 11, wherein the planar array antenna further comprises at least one non-tapered planar array antenna tile comprising:

a plurality of patch antenna elements; and a transmit feed distribution network that distributes power equally among the patch antenna elements, the transmit feed distribution network connecting the plurality of patch antenna elements to a transmit feed point driving the non-tapered planar array antenna tile.

13. The system of claim 11, wherein each of the plurality of planar array antenna tiles comprises a custom power distribution pattern that contributes to the shading pattern.

14. The system of claim 13, wherein the feed network element comprises a printed circuit board ("PCB") trace comprising a branch feeding each patch antenna element, wherein each branch to a patch antenna element comprises a width based on the custom power distribution pattern.

15. The system of claim 13, wherein one or more patch antenna elements within a first planar array antenna tile positioned along an exterior portion of the planar array antenna are powered by a feed network element for the first planar array antenna tile at a power level lower than one or more of:

patch antenna elements of the first planar array antenna tile in closer to an interior of the planar array antenna tile; and patch antenna elements of a second planar array antenna tile positioned closer to the interior of the planar array antenna than the first planar array antenna tile.

16. The system of claim 11, wherein the feed network element comprises a printed circuit board ("PCB") trace, the PCB trace having a first branch connecting a first patch antenna element to the transmit feed point and a second branch connecting a second patch antenna to the transmit feed point, wherein a width of the first branch is greater than a width of the second branch.

17. The system of claim 11, wherein the feed network element distributes transmit power at a first power level to one or more interior elements and at a second power level to one or more edge elements, the first power level being greater than the second power level.

18. An apparatus comprising:

a planar array antenna tile having a plurality of patch antenna elements, wherein the plurality of patch antenna elements comprises a plurality of edge elements and at least one interior element;

a transmit feed point that drives the antenna tile;

a receive feed point;

a first printed circuit board ("PCB") trace that distributes power unequally among two or more of the patch antenna elements, the first PCB trace having a first branch connecting the at least one interior element to the transmit feed point and a second branch connecting an edge element of the plurality of edge elements to the transmit feed point, wherein a width of the first branch is greater than a width of the second branch; and a second PCB trace connecting the plurality of patch antenna elements to the receive feed point, wherein the second PCB trace equally illuminates all patch antenna elements of the planar array antenna tile.

* * * * *